United States Patent [19]

Herold

[11] 3,987,658

[45] Oct. 26, 1976

[54] GRAPHITE FORGING DIE

[75] Inventor: Robert Andrew Herold, Tolland, Conn.

[73] Assignee: United Technologies Corporation, Hartford, Conn.

[22] Filed: Dec. 12, 1975

[21] Appl. No.: 640,307

[52] U.S. Cl. ..... 72/342; 72/476; 72/700; 76/107 R

[51] Int. Cl.[2] ..... B21J 13/02

[58] Field of Search ..... 76/107 R; 106/56; 72/342, 377, 700, 462, 476

[56] References Cited

UNITED STATES PATENTS

| | | | |
|---|---|---|---|
| 1,940,294 | 12/1933 | Calkins | 76/107 |
| 2,275,420 | 3/1942 | Clark et al. | 76/107 |
| 2,363,337 | 11/1944 | Kelly | 76/107 |
| 3,705,509 | 12/1972 | Haller | 76/107 |

*Primary Examiner*—Lowell A. Larson
*Attorney, Agent, or Firm*—Edward J. Timmer

[57] ABSTRACT

Graphite having a compressive strength at room temperature of at least 10,000 psi is an improved die material useful in the forging of high strength alloys which are in a temporary condition of low strength and high ductility in hot die means.

16 Claims, No Drawings

GRAPHITE FORGING DIE

BACKGROUND OF THE INVENTION

1. Field of Invention

The present invention relates to a method of forging high strength alloys, particularly those adapted to gas turbine engine use, in hot die means at elevated temperatures. In particular, an improved die material useful in an apparatus for such a forging process is disclosed.

2. Description of the Prior Art

The problems associated with fabricating high strength alloys, such as those used in gas turbine engines, are well known. A solution to these problems is discussed in the Moore et al patent, U.S. Pat. No. 3,519,503, which has a common assignee with the present invention. By the fabrication method of the patent, high strength alloy billets are processed in compression under controlled conditions of temperature and reduction to place the alloy in a temporary condition of low strength and high ductility and are subsequently forged at a low strain rate in hot dies at a temperature which will maintain the alloy in the aforementioned temporary condition. The forged alloy is then returned to its normal condition of high strength and hardness by conventional heat treatment. An apparatus for use in such a forging process is disclosed in the Moore et al patent, U.S. Pat. No. 3,698,219, which also has a common assignee with the present invention.

During the slow forging step of the process, the alloy must be worked within about 350° F of its normal recrystallization temperature, which may be 1800° F or above in the case of nickel-base superalloys, in order to maintain it in a temporary condition of low strength and high ductility until the desired shape is produced. This necessitates heating the dies to a similar temperature and preferably maintaining that temperature substantially uniformly throughout the dies. As a result, the dies must be made of a material which is capable of withstanding high compressive forces at elevated temperatures and which preferably possesses sufficient thermal conductivity to insure uniform temperature distribution throughout the dies. In the prior art, refractory alloys or superalloys have been found suitable as such die materials. For example, such materials as TZM molybdenum alloy, TRW2278 nickel-base alloy and the nickel-base alloy of U.S. Pat. No. 3,655,462 have been widely used. However, these materials, as well as other similar materials, are extremely expensive and difficult to machine. A non-metallic die material useful in high temperature forging is disclosed in copending application entitled "Diffusion Bonding Separator" and assigned Ser. No. 298,043, now U.S. Pat. No. 3,945,240.

The Jahn patent, U.S. Pat. No. 3,917,884, discloses a method of making carbon-carbon reinforced shapes which may find application as hot pressing molds in fabricating ceramic or refractory metal powders. In hot pressing, the metal powder is placed in a mold and pressed therein at an elevated temperature and pressure so that diffusion bonding of the powder particles occurs. An inherent limitation of hot pressing refractory metal powder in a mold is that only simple shapes, such as cylinders, bars or the like, can be made. Thus, the molds utilized are of simple shape and have no intricate details incorporated therein. On the other hand, in forging high strength alloys in accordance with the Moore et al patents, dies of intricate detail are utilized to produce complex articles, such as gas turbine engine parts. Such dies contain numerous stress raisers, including sharp radii, notches and the like, which magnify the stress exerted on the dies during forging.

SUMMARY OF THE INVENTION

The present invention relates to the forging of high strength alloys and has particular applicability to those processes wherein alloys which are in a temporary condition of low strength and high ductility are forged in hot die means at a temperature which will maintain the alloy in said condition until the desired shape is produced. It is especially suited to forging high strength alloys into articles of intricate shapes such as gas turbine engine parts, including discs.

More specifically, the present invention involves providing in an apparatus for such a forging process an improved die material which not only possesses sufficient compressive strength and thermal conductivity but also is low in cost and readily machined. Graphite is known to be low in cost compared to the prior art die materials, easily machined and to exhibit excellent thermal conductivity. However, compressive strength values for graphite at room temperatures would lead one to conclude that graphite would not have the requisite strength for use as a die material in high temperature forging, especially of articles of intricate shape. However, graphite is one of a few materials which increases in compressive strength as temperature increases (up to about 2700° C). From experimental forging tests, it was discovered that graphite having a compressive strength of a least 10,000 psi at room temperature would provide a die material not only low in cost, easily machined and having excellent thermal conductivity but also having the requisite compressive strength at the temperatures used in forging high strength alloys by the advanced techniques described above. To prolong die life, a preferred die material is graphite having a compressive strength of at least 15,000 psi at room temperature.

DESCRIPTION OF THE PREFERRED EMBODIMENT

The present invention is especially useful in forging high strength alloys, such as nickel-base alloys, titanium base alloys and the like, into intricate shapes in accordance with the teachings of the Moore et al patents. However, it is also applicable to other forging techniques and apparatus of a similar nature.

In the practice of the invention, the die means, which includes solid dies, die inserts and the like, are fabricated by conventional means from a graphite having a compressive strength at room temperature of at least 10,000 psi. The graphite may be provided in various forms, which derive from its method of manufacture. For example, the graphite can be provided in molded or extruded form. If the graphite is molded, it will have a fine, equiaxed grain structure and essentially isotropic properties. If the graphite is extruded, it will have a grain structure elongated in the direction of extrusion and anisotropic properties. Both forms of graphite, as well as others, can be used as die materials so long as the compressive strength at room temperature is at least 10,000 psi. Because anisotropic properties may require a special die design, graphite in molded form is preferred. A molded graphite having a compressive strength at room temperature of at least 10,000 psi is sold under the trademark UCAR-CMB by the Union Carbide Corporation. If it is desired to provide a die means with very sharp radii and the like, the preferred form of graphite is that which has been woven and subsequently sintered. This form of graphite is much less notch sensitive than the forms already mentioned. A woven and sintered graphite having a compressive strength at room temperature of at least 10,000 psi is sold under the trademark Filcarb by Fiber Materials Incorporated.

To prolong the life of the graphite die means, it may be desirable and preferred to employ a graphite having a compressive strength of at least 15,000 psi at room temperature.

In forging high strength alloys, a billet of the alloy in a temporary condition of low strength and high ductility and the graphite die means are heated conventionally to the appropriate forging temperature. For example, for IN100 having a nominal composition of 10% chromium, 15% cobalt, 4.5% titanium, 5.5% aluminum, 3% molybdenum, balance essentially nickel, a temperature of about 1900° to 2000° F is used during the forging operation to retain the alloy in the temporary condition described above. Since graphite will oxidize excessively if heated in air above about 1000° F, it is desirable to conduct heating and forging in a nonoxidizing atmosphere such as an inert gas, vacuum or the like. Under such circumstances, it is desirable to heat the graphite die means by induction coils. After the forging temperature is attained, the die means are forced together under pressure to effect solid state deformation, i.e. extensive plastic deformation and flow, of the billet into and across the die means at a desired strain rate. In the case of IN100, the pressure would typically be in the range of 1500 to 3000 psi for a strain rate in the range of 0.05 to 0.5 in/in/min. Of course, the pressure and strain rate utilized will vary with the alloy being forged. For most high strength alloys, a strain rate of 0.1 in/in/min or less is preferred to prolong the life of the graphite die means. The forged part may thereafter be removed from the die means and subjected to conventional heat treatment to return the alloy to its normal condition of high strength and hardness. Intricate gas turbine engine parts, such as discs, are readily manufactured by this process.

In a preferred practice, forging is conducted in at least two forging passes. The first pass provides a part having all the vertical thicknesses forged while the second pass provides the final intricate part configuration by forging sharp radii and the like. The two pass forging practice reduces the total compressive force exerted on the die means and thereby increases their useful life.

Several advantages accrue when graphite of the requisite compressive strength is used as a die material in forging high strength alloys. First, no parting agent or high temperature lubricant is required when using such material, since graphite itself is a high temperature lubricant. Second, if a nonoxidizing atmosphere is used in forging, the die means can be heated directly by induction coils without the aid of a susceptor, which is required in heating prior art die materials in such atmospheres.

Although the invention has been shown and described with respect to illustrative embodiments thereof, it should be understood by those skilled in the art that changes may be made therein without departing from the spirit and scope of the invention.

Having thus described typical embodiments of my invention, that which I claim as new and desire to secure by Letters Patent of the United States is:

1. In an apparatus for forging a high strength alloy, which is in a temporary condition of low strength and high ductility, in hot die means at an elevated temperature, the improvement which comprises:

die means comprising graphite having a compressive strength at room temperature of at least 10,000 psi.

2. The apparatus of claim 1 in which the die means comprises graphite having a compressive strength of at least 15,000 psi at room temperature.

3. The apparatus of claim 1 in which the graphite is in molded form.

4. The apparatus of claim 1 in which the graphite is in woven and sintered form.

5. In a forging process wherein a high strength alloy in a temporary condition of low strength and high ductility is deformed in hot die means at a temperature which will maintain the alloy in said condition until the desired shape is produced, the improvement which comprises:

deforming said alloy in hot die means comprising graphite having a compressive strength at room temperature of at least 10,000 psi.

6. The method of claim 5 wherein said die means comprise graphite having a compressive strength of at least 15,000 psi at room temperature.

7. The method of claim 5 wherein the graphite is in molded form.

8. The method of claim 5 wherein the graphite is in woven and sintered form.

9. The method of claim 5 wherein a nonoxidizing atmosphere is maintained around the die means during heating and forging.

10. The method of claim 5 wherein the alloy is deformed at a strain rate of 0.1 in/in/min or less.

11. The method of claim 5 wherein said alloy is adapted to gas turbine engine use.

12. The method of claim 11 wherein said alloy is a nickel-base superalloy.

13. In a method of fabricating an article from a high strength alloy billet wherein the billet is worked compressively to place the alloy in a temporary condition of low strength and high ductility, forged in hot die means at a temperature which will maintain the alloy in said condition and heat treated to restore the alloy to its normal condition of high strength and hardness, the improvement which comprises:

forging the billet in hot die means comprising graphite having a compressive strength at room temperature of at least 10,000 psi.

14. The method of claim 13 wherein said die means comprise graphite having a compressive strength of at least 15,000 psi at room temperature.

15. The method of claim 13 wherein the article is a gas turbine engine part.

16. The method of claim 13 wherein the alloy is adapted to gas turbine engine use.

* * * * *